US009834333B1

(12) United States Patent
Ness

(10) Patent No.: US 9,834,333 B1
(45) **Date of Patent: *Dec. 5, 2017**

(54) OFFSHORE CARGO RACK FOR USE IN TRANSFERRING PALLETIZED LOADS BETWEEN A MARINE VESSEL AND AN OFFSHORE PLATFORM

(71) Applicant: Tom Gurtner, Metairie, LA (US)

(72) Inventor: Daniel W. Ness, Metairie, LA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/975,345

(22) Filed: Dec. 18, 2015

Related U.S. Application Data

(63) Continuation of application No. 14/317,026, filed on Jun. 27, 2014, now Pat. No. 9,216,841.

(60) Provisional application No. 61/840,453, filed on Jun. 27, 2013.

(51) Int. Cl.
*B60P 7/00* (2006.01)
*B65D 19/00* (2006.01)

(52) U.S. Cl.
CPC ..... *B65D 19/00* (2013.01)

(58) Field of Classification Search
CPC ..... B65D 19/00
USPC ..... 410/31, 36, 46; 211/71.01, 85.18; 108/55.1, 57.13; 220/1.5
See application file for complete search history.

(56) References Cited

U.S. PATENT DOCUMENTS 2,579,655 A 12/1951 Donald
2,683,010 A 7/1954 Hamerslag, Jr.
3,776,435 A 12/1973 Smith
3,916,803 A 11/1975 Garcia
4,165,806 A 8/1979 Cayton
4,403,556 A 9/1983 Van Gompel
4,828,311 A 5/1989 Hayashi
5,078,415 A 1/1992 Goral
5,154,556 A 10/1992 Wappel
5,156,233 A 10/1992 Olsen et al.
5,292,012 A 3/1994 Davis et al.
5,507,237 A 4/1996 Barrow et al.
5,906,165 A 5/1999 McCorkle, Jr. et al.
6,058,852 A 5/2000 Estvanko
6,357,365 B1 3/2002 Higgins et al.
6,371,299 B1 4/2002 Essary
6,422,405 B1 7/2002 Haenszel
6,668,735 B2 12/2003 Cassina
6,725,783 B2 4/2004 Sekino
(Continued)

*Primary Examiner* — Stephen Gordon
(74) *Attorney, Agent, or Firm* — Garvey, Smith & Nehrbass, Patent Attorneys, L.L.C.; Charles C. Garvey, Jr.; Vanessa M D'Souza

(57) ABSTRACT

A cargo rack for transferring loads between a marine vessel and an offshore marine platform (for example, oil and gas well drilling or production platform) provides a frame having a base, a front, a rear, upper and lower end portions and side walls. The lower end of the frame has a floor. Openings in the base align with forklift tine tubes or sockets. The frame includes a pair of fixed side walls extending upwardly from the base that include at least left and right side walls. A plurality of gates are movably mounted on the frame including a gate at least at the front and at least at the rear of the frame, each gate being movable between open and closed positions. The gates enable a forklift to place loads on the floor by accessing either the front of the frame or the rear of the frame. Each gate can be pivotally attached to a corner column.

22 Claims, 9 Drawing Sheets

(56) References Cited

U.S. PATENT DOCUMENTS

| | | | | |
|---|---|---|---|---|
| 6,983,704 | B1 | 1/2006 | Ness | |
| 7,070,372 | B2 | 7/2006 | Denike et al. | |
| 7,997,214 | B1 | 8/2011 | Ness | |
| 9,216,841 | B1 * | 12/2015 | Ness | B65D 19/00 |

* cited by examiner

OFFSHORE CARGO RACK FOR USE IN TRANSFERRING PALLETIZED LOADS BETWEEN A MARINE VESSEL AND AN OFFSHORE PLATFORM

CROSS-REFERENCE TO RELATED APPLICATIONS

This is a continuation of U.S. patent application Ser. No. 14/317,026, filed 27 Jun. 2014 (issued as U.S. Pat. No. 9,216,841 on 22 Dec. 2015), which claims benefit of U.S. Provisional Patent Application Ser. No. 61/840,453, filed 27 Jun. 2013, which is hereby incorporated herein by reference.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to cargo racks for transferring goods between marine vessels and offshore platforms such as oil and gas well drilling and production platforms. More particularly, the present invention relates to an improved cargo rack that enables a user to load the rack with multiple palletized loads (or other loads) and to then transport the entire rack using a lifting device such as a crane or a forklift from the marine vessel to the platform.

2. General Background

In the exploration of oil and gas in a marine environment, fixed, semi submersible, jack up, and other offshore marine platforms are used during drilling operations. Fixed platforms are typically used for production of oil and gas from wells after they have been drilled. Drilling and production require that an enormous amount of supplies be transported from land based storage facilities. Supplies are typically transferred to offshore platforms using very large marine vessels called work boats. These work boats can be in excess of one hundred feet in length and have expansive deck areas for carrying cargo that is destined for an offshore platform. Supplies are typically transferred from a land based dock area to the marine vessel using a lifting device such as a crane or a mobile lifting and transport device such as a forklift.

Once a work boat arrives at a selected offshore platform, supplies or products are typically transferred from the deck of the work boat to the platform using a lifting device such as a crane.

Once on the deck of a drilling platform or production platform, space is at a premium. The storage of supplies on an offshore oil well drilling or production platform is a huge problem.

Many cargo transport and lifting devices have been patented. The table below lists some patents, each of which is incorporated herein by reference, that relate generally to pallets, palletized racks, and other cargo racks:

TABLE 1

| Pat. No. | Title | Issue Date MM-DD-YYYY |
|---|---|---|
| 2,579,655 | Collapsible Container | Dec. 25, 1951 |
| 2,683,010 | Pallet and Spacer | Jul. 6, 1954 |
| 3,776,435 | Pallet | Dec. 4, 1973 |
| 3,916,803 | Loading Platform | Nov. 14, 1975 |
| 4,165,806 | Palletizing System for Produce Cartons and the Like | Aug. 28, 1979 |
| 4,403,556 | Drum Retainer | Sep. 13, 1983 |
| 4,828,311 | Metal Form Pallet | May 9, 1989 |
| 5,078,415 | Mobile Carrier for Gas Cylinders | Jan. 7, 1992 |
| 5,156,233 | Safety Anchor for Use with Slotted Beams | Oct. 20, 1992 |
| 5,292,012 | Tank Handling and Protection Structure | Mar. 8, 1994 |
| 5,507,237 | Lifting Apparatus for Use with Bulk Bags | Apr. 16, 1996 |
| 5,906,165 | Stackable Tray for Plants | May 25, 1999 |
| 6,058,852 | Equipment Skid | May 9, 2000 |
| 6,357,365 | Intermediate Bulk Container Lifting Rack | Mar. 19, 2002 |
| 6,371,299 | Crate Assembly and Improved Method | Apr. 16, 2002 |
| 6,422,405 | Adjustable Dunnage Rack | Jul. 23, 2002 |
| 6,668,735 | Pallet with a Plastic Platform | Dec. 30, 2003 |
| 6,725,783 | Pallet for Stacking Planographic Printing Plates Thereon | Apr. 27, 2004 |
| 6,983,704 | Offshore Cargo Rack for Use in Transferring Palletized Loads Between A Marine Vessel And An Offshore Platform | Jan. 10, 2006 |
| 7,997,214 | Offshore Cargo Rack for Use in Transferring Palletized Loads Between A Marine Vessel And An Offshore Platform | Aug. 16, 2011 |

BRIEF SUMMARY OF THE INVENTION

The present invention provides an improved cargo rack apparatus that includes a frame having a front, a rear, side walls, and upper and lower end portions.

The lower end portion of the frame provides a base that can have preferably a plurality of beams that arc welded together. The base can have a floor.

A pair of open-ended parallel forklift tine tubes or sockets can be provided on the base.

The frame preferably includes side walls that extend upwardly from the base including at least left and right side walls. There can be front and rear gated end walls.

Each gate can be movable between open and closed positions. The gates enable a forklift to place loads on the floor by accessing either the front or the rear of the frame.

The present invention includes a cargo rack comprising a frame having a base, a front, a rear, and upper and lower end portions. The base of the frame can have a perimeter and a floor providing multiple load holding positions, each configured to hold a load module. A plurality of load modules can be supported with the frame during use. The frame can include a plurality of side walls that attach to and extend upwardly from the perimeter beam base and including at least left and right side walls, first and second frame ends, the frame having four corners with a corner column at each corner. Each side can have at least one intermediate column positioned in between two corner columns. The upper end portion of each side wall can have an upper horizontal beam that connects the upper end of each corner column to each intermediate column. A plurality of gates can be movably mounted to the frame, each gate being movably attached to a side wall between open and closed positions, each gate spanning across a said end in a horizontal direction from one corner column to another corner column. Multiple reinforcements can connect each intermediate column to corner columns on the side walls, including reinforcing beams that extend between a corner column and an intermediate column at a position in between the base and the upper horizontal beam. The reinforcements can include a diagonally extending beam that extends from the top of a said corner column downwardly to a position next to the lower end of a said intermediate column. A plate can connect the lower end of a said diagonal member to both the base and a said intermediate column. Wherein the gates can enable a module to be removed laterally with a fork lift when a selected said gate is in the open position and without removing the other module.

In one embodiment, there can be two load holding positions.

In one embodiment, the present invention can further comprise a laterally extending beam on each side that can extend from a corner column to a diagonally extending beam.

In one embodiment, there can be a drain opening in the floor on one of the load holding positions.

In one embodiment, there can be a plate opening.

In one embodiment, the present invention can further comprise a pair of tanks, one on each load holding position.

In one embodiment, the present invention can further comprise a dividing beam that one load holding position separates from the other.

The present invention can provide a cargo rack that includes a frame having a base with a base perimeter that includes a plurality of beams, a front, a rear, upper and lower end portions, the frame holding at least a pair of load modules. The frame can include a plurality of side walls and end walls extending upwardly from the base at the base perimeter and including at least left and right side walls, four corners that each provide a corner column and an intermediate column spaced in between two said corner columns. The upper portion of each side wall can have an upper horizontal beam that connects the upper end of each corner column to each intermediate column. The end walls can be gates that are movably mounted to the frame, each gate being movable between open and closed positions, each gate extending between two corner columns. Multiple reinforcements can connect each intermediate column to corner columns on said side walls, including reinforcing beams that extend both horizontally and diagonally between a corner column and an intermediate column at a position in between the base and the upper horizontal beam. A plate can connect the lower end of a said diagonal member to both the base and a said intermediate column. Wherein the gates can enable any one of the load modules to be removed laterally with a fork lift when a selected said gate is in the open position and without removing any other module.

In one embodiment, there can be a gate at each end of the frame.

In one embodiment, there can be multiple diagonally extending beams that intersect multiple horizontally extending beams.

In one embodiment, the floor can include inclined portions.

In one embodiment, there can be a drain in the floor.

In one embodiment, the floor can attach to the perimeter beams.

In one embodiment, the floor can attach to the upper end portion of at least one of the perimeter beams.

In one embodiment, the present invention further comprises a vertical support next to each corner column that can be mounted to the base and that can connect at intervals to the said corner column.

In one embodiment, there can be multiple hinge mounts that attach to both a said corner column and a said vertical support.

The present invention provides a cargo rack that can include a frame that can have a base with a floor, a front, a rear, upper and lower end portions. A plurality of load modules can be supported within the frame and upon the floor during use. The frame includes a plurality of side walls extending upwardly from the base including at least left and right side walls, the frame having four corners, corner column at each corner and at least one intermediate column connected to the base and positioned in between two corner columns. The upper end portion of each side wall can have an upper horizontal beam that connects the upper end of each corner column to each intermediate column. A plurality of gates can be movably mounted on the frame at a said frame end, each gate being movable between open and closed positions, the gates enabling the load modules to be loaded laterally to the floor when a said gate is opened. Multiple reinforcements can connect each intermediate column to corner columns on side walls, including reinforcing beams that extend between a corner column and an intermediate column at a position in between the base and the upper horizontal beam and multiple diagonal beams that each connect to a reinforcing beam and to a said column. The floor can have a plurality of load holding positions. Wherein the gates enable any one of the modules to be removed laterally with a fork lift when a said gate is opened, and wherein no other module is moved.

In one embodiment, each corner column can be supported by a vertical support attached to the floor.

In one embodiment, the vertical support can attach to the corner column at intervals.

In one embodiment, the floor can be inclined.

In one embodiment, the intermediate column can be connected to the diagonally extending beam with a plate.

In one embodiment, the plate can have horizontal and vertical components.

In one embodiment, the plate can have an opening.

In one embodiment, the present invention can further comprise one or more transverse beams that can connect the intermediate columns.

In one embodiment, the present invention can further comprise raised pedestals that can extend above the floor for providing indexing for receipt of a load placed on a load holding position of the frame.

The present invention includes a method of transporting load modules, comprising the steps of providing a frame having a base with a floor, a front, a rear, and upper and lower end portions, and a pair of open ended parallel fork lift tine sockets, the frame can include a plurality of side walls extending upwardly from the base and including at least left and right side walls, the side walls can have corner columns and intermediate columns, each intermediate column can be position in between two corner columns. The upper end portion of each side wall can have an upper horizontal beam that connects the upper end of each corner column to each intermediate column. A plurality of gates can be mounted to the frame, each spanning between two corner columns, each gate being movable between open and closed positions, the open position of each gate providing an open doorway, the gates enabling a fork lift to place a selected one of the load modules on the floor by moving the selected load module laterally through a said open doorway. Multiple reinforcement can connect each intermediate column to corner columns on the side walls, including reinforcing beams that extend between a corner column and an intermediate column at a position in between the base and the upper horizontal beam and multiple diagonal beams. The floor can have a plurality of load holding positions, each having one or more restraints that both vertically and laterally hold a load module in position once the load is placed on the floor. Wherein the present invention can include the gates exposing a majority of the width of the floor for loading when opened. The gates can enable removal of any one of the four modules laterally with a fork lift when a said gate is opened and without removing any other module. Each diagonal beam can be connected to both the floor and a said intermediate beam with a plate.

In one embodiment, there can be a pair of gates.

In one embodiment, there can be horizontal and vertical components of said plate.

In one embodiment, the floor can be at least partially inclined.

In one embodiment, there can be a plate opening in the plate.

In one embodiment, the plate can attach to the floor at a position spaced away from an intermediate beam.

In one embodiment, the present invention can further comprise lift eyes on the corner columns.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

FIGS. 1-18 show a preferred embodiment of the present invention designated generally by the numeral 10. Transportable rack apparatus 10 is designed to hold a pair of tank modules upon floor or platform 12, one tank module in each of the two floor segments 19, 20. Apparatus 10 can be of welded and bolted structural steel construction.

Figure 9:
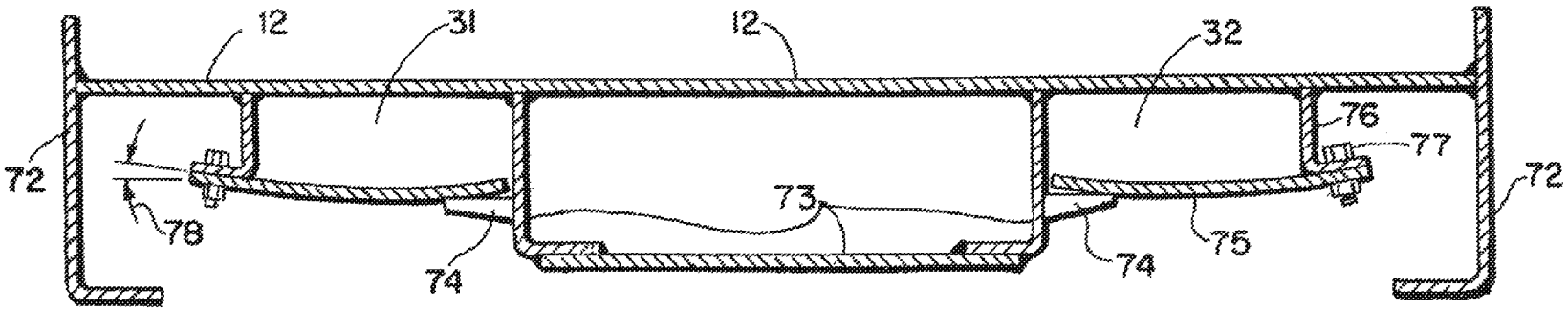
FIG. 9 is a fragmentary view of a preferred embodiment of the apparatus of the present invention taken along lines 9-9 of FIG. 2 and showing the fork tube sections and torque tube.
Figure 10:
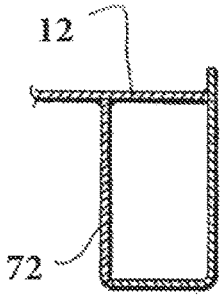
FIG. 10 is a fragmentary view of a preferred embodiment of the apparatus of the present invention showing perimeter beam detail.
Figure 11:
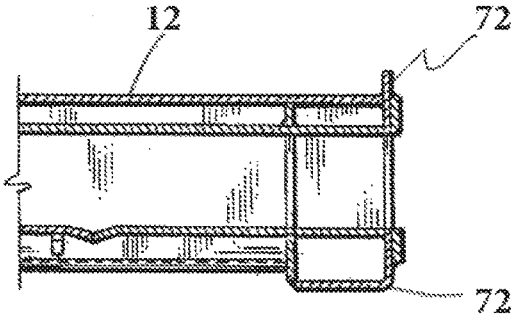
FIG. 11 is a fragmentary view of a preferred embodiment of the apparatus of the present invention taken along lines 11-11 of FIG. 2 showing perimeter beam detail.
Figure 12:
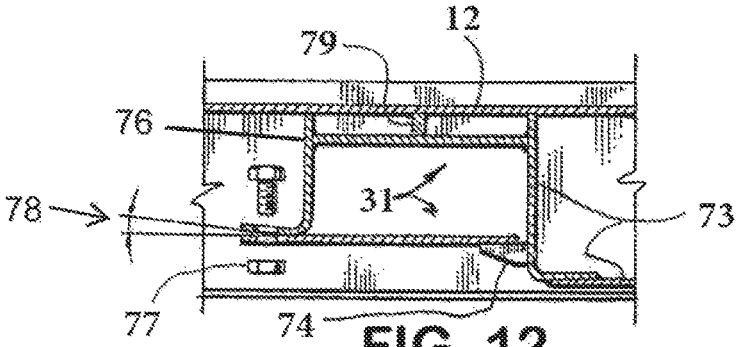
FIG. 12 is a fragmentary view of a preferred embodiment of the apparatus of the present invention showing fork tube section.
Figure 13:
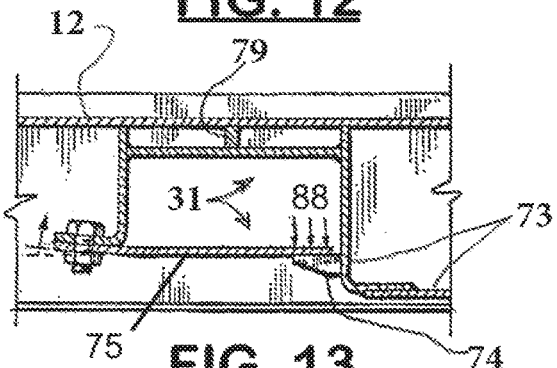
FIG. 13 is a fragmentary view of a preferred embodiment of the apparatus of the present invention taken along lines 13-13 of FIG. 2 showing fork tube section.
Figure 14:
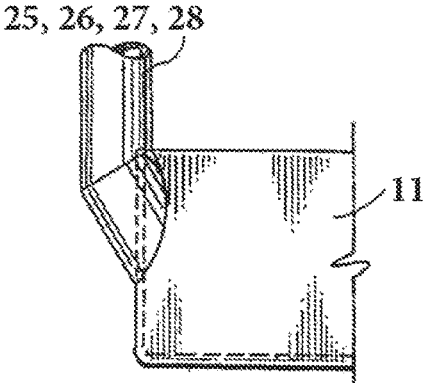
FIGS. 14-15 are fragmentary views of a preferred embodiment of the apparatus of the present invention showing corner details.
Figure 15:
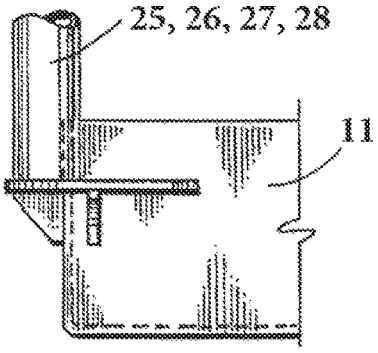

Rack apparatus 10 has a base or substructure 11 that can be of welded beams and plate steel or other suitable structural material. Base or substructure 11 has sockets or tubes 31, 32 which are receptive of the tines of a forklift, thus enabling the apparatus 10 to be lifted and transported with such a forklift. In FIGS. 9 and 12-13, a torque tube 73 is positioned in between sockets 31, 32. FIGS. 10-11 show perimeter or rim beam or beams 72 attached to and extending down from floor 12. Gussets 74 are attached to torque tube 73. Fork tube bottom plates 75 abut gussets 74. Fork tube side plates 76 have an ell shape with the lower part of the plate 76 angled (see angle 78, FIGS. 9 and 12) to load plate 75 against gusset 74 (see arrows 88). Bolted connections 77 can attach each bottom plate 75 to a side plate 76. Plate 76 can be welded at its upper end portion to the underside of floor 12. Torque tube 73 can be welded to the underside of floor 12. Spacer or plate 79 is in between floor 12 and socket 31, 32.

Figure 1:
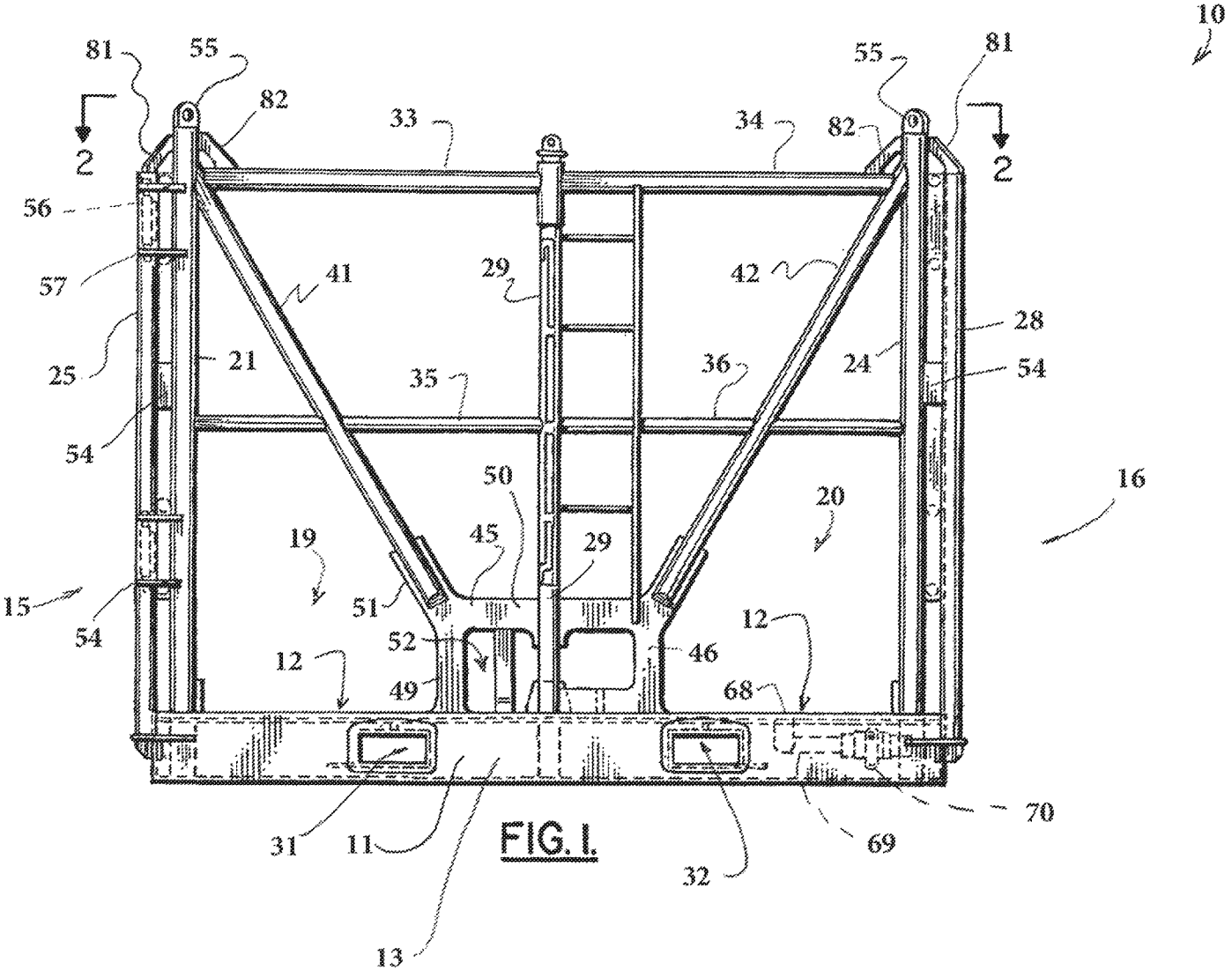
FIG. 1 is a side elevation view of a preferred embodiment of the apparatus of the present invention taken along lines 1-1 of FIG. 2.
Figure 16:
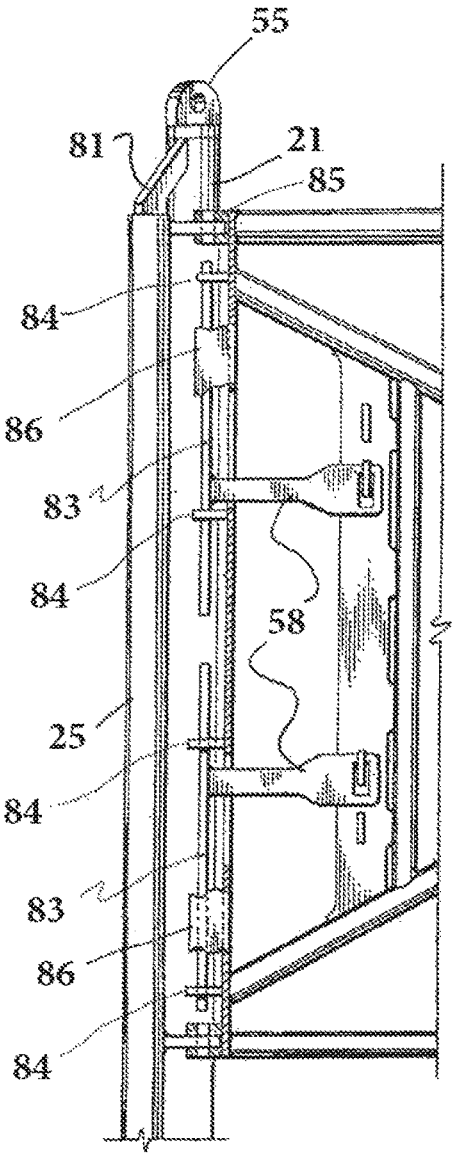
FIGS. 16-18 are fragmentary views of a preferred embodiment of the apparatus of the present invention that illustrate the gate latches.
Figure 17:
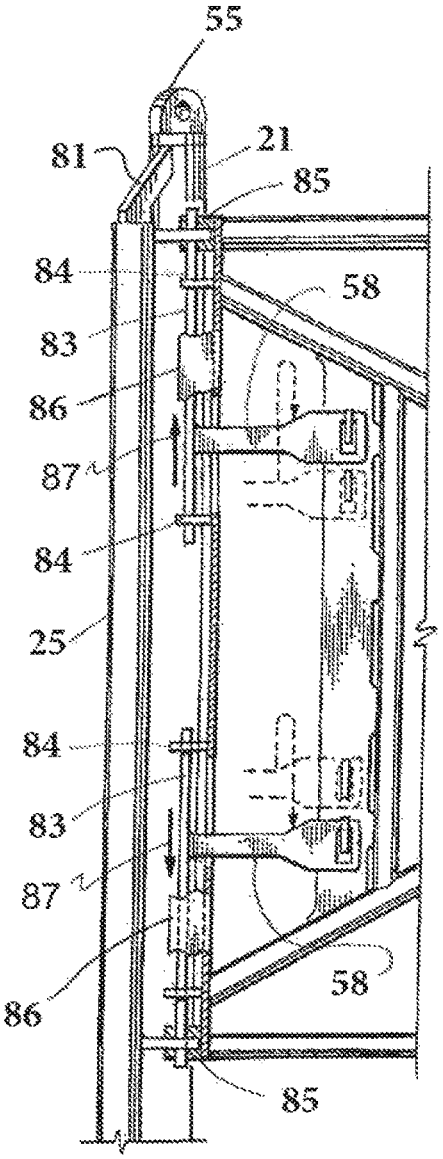
Figure 18:
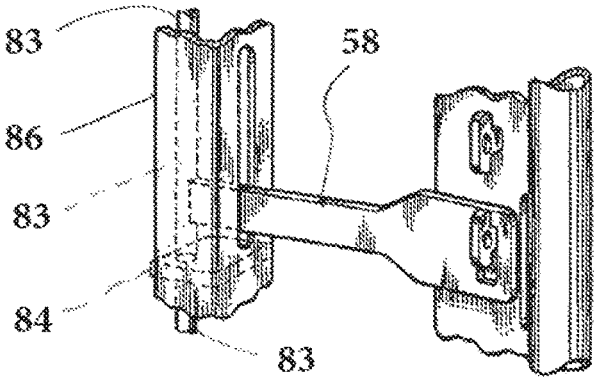

Sides 13, 14 extend upwardly from base 11. Base 11 has ends 15, 16, each provided with a door. The end 15, has door 17. The end 16 has door 18. Each door 17, 18 pivots between open and closed positions (see arrows 53, FIG. 2). Gate 18 pivots on hinges 65 that are attached (e.g., welded) to support 27. Gate 17 pivots on hinges 66 that are attached (e.g., welded) to support 25 (see FIGS. 3-4). Gate latches 58 are provided for enabling each door 17 or 18 to be locked or latched in a closed position as shown in hard lines in FIGS. 1-5, 8, and 16-18. In FIGS. 16-18, each latch 58 includes a vertical rod 83 mounted in bearings 84. When rod 83 enters locking tube 85, the latch 58 is locked. When rod 83 is removed from locking tube 85, latch 58 is unlocked so that door 17 or 18 can be opened. In FIG. 16, rods 83 are in the unlocked position. In FIG. 17, rods 83 are in the locked position. Arrows 87 show movement to the locked position. Bearings 84 can be supported by vertical beam 86. Each side 13, 14 has an upper horizontal beams, lower horizontal beams and diagonal beams. In FIG. 1, side 13 had upper horizontal beams 33, 34 and lower horizontal beams 35, 36. Each horizontal beam 33, 34, 35, 36 spans from a corner column 21 or 24 to an intermediate column 29. Diagonal beams 41, 42 are provided as seen in FIG. 1. Each diagonal beam 41, 42 extends from a corner column 21 or 24 to connect with a plate 45 or 46. Each diagonal beam 41 or 42 is connected (e.g., welded) to an upper horizontal beam 33 or 34 and to a lower horizontal beam 35 or 36 as seen in FIG. 1. Similarly or identically constructed to side 13, side 14 would have upper horizontal beams 37, 38 and lower horizontal beams 39, 40 as well as diagonal beams 43, 44 (see FIG. 5).

The rack apparatus 10 of the present invention is of an improved construction that is very rugged for use in hostile marine and offshore environments and when supporting heavy leads such as liquid filled tanks or vessels. Corner columns 21, 22, 23, 24 extend upwardly from each corner of base 11. Each corner column 21-24 is fitted with a lifting eye 55 as shown in the detail of FIGS. 1-5, 8, 16-17. The lifting eye 55 can be fitted with couplers such as shackles and slings in order to effect a lift of the combination of rack apparatus 10 and contained tank modules.

Each corner column 21, 22, 23, 24 is reinforced with a vertical support 25, 26, 27 or 28. Plates 54 or hinges 65, 66 span between each corner column 21-24 and its vertical support 25-28. One or more plates 54 can be used to form a connection between each corner column 21, 22, 23 or 24 and its vertical support 25, 26, 27, 28.

A pair of intermediate columns 29, 30 are provided, each being about midway between ends 15, 16 (see FIGS. 1-2 and 5-8). Reinforcements connect between each corner column 21, 22, 23, 24 and an intermediate column 29 or 30. These reinforcements include upper horizontal beams 33, 34, 37, 38. Diagonal beams 41, 42, 43, 44 are provided. Each diagonal beam 41-44 extends from a position at the upper end of a corner column 21-24 to a plate 45, 46, 47, 48 (see FIGS. 1 and 5).

Figure 5:
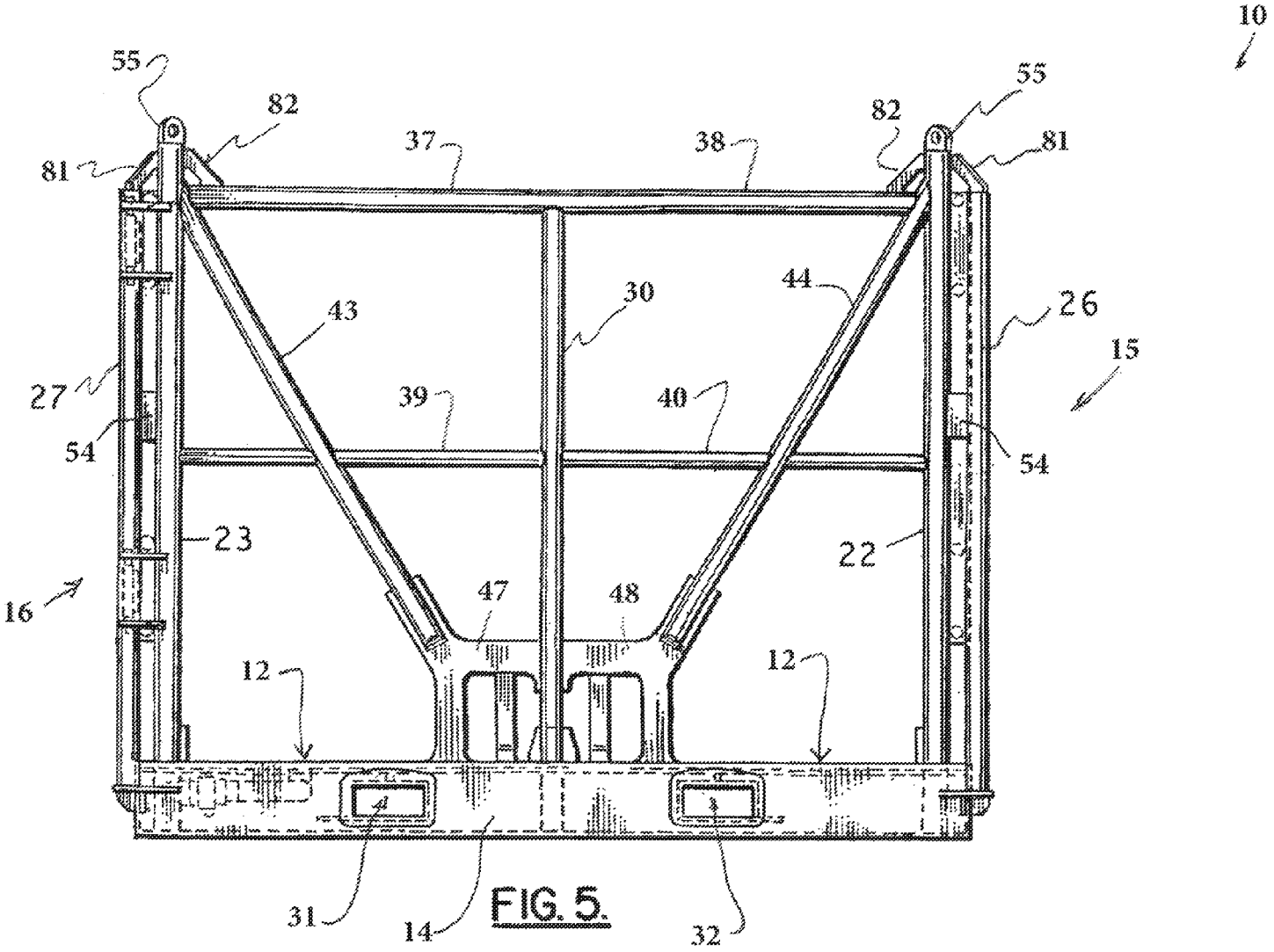
FIG. 5 is an elevation view of a preferred embodiment of the apparatus of the present invention taken along lines 5-5 of FIG. 2.

Each plate 45, 46, 47, 48 preferably provides a vertical section 49, horizontal section 50, diagonal section 51 and an opening 52. The vertical section 49 of each plate 45-48 attaches (e.g., welded) to base 11. The horizontal section 50 of each plate 45, 46, 47, 48 attaches to an intermediate column 29, 30. A diagonal section 51 of plate 45, 46, 47, 48 attaches to the lower end portion of a diagonal beam 41-44 as can be seen in FIGS. 1 and 5.

Each lifting eye 55 is attached to a corner column 21, 22, 23, 24. In FIGS. 1 and 5, corner column 21, 22, 23, 24 provides a lifting eye 55. Also seen in FIGS. 1 and 5 are the vertical supports 25-28 that reinforce the corner columns 21-24. Also seen in FIG. 5 are plate sections 54 that are welded to both intermediate column 23 and vertical support 27. Hinge pin 56 (see FIG. 3) extends between the horizontal hinge plate 57 of hinges 65 or 66 and provides a location for attachment of a door 17 or 18.

Fall arrest pole 59 (see FIGS. 6-7) telescopes inside of intermediate column 29. Pole 59 can provide eyelet 60 that accepts linkage for connecting a workers safety harness to pole 59 when pole 59 is extended (see arrow 80, FIG. 7). Pole 59 can be locked in the elevated position 61 of FIG. 7.

Diagonally extending plates 81, 82 extend downwardly from corner column 21-24 just below lifting eye 55. Plate 81 connects with the top of a vertical support 25-28. Plate 82 connects (welded) to an upper horizontal beam 33, 34, 37, 38. The plates 81, 82 prevent lift lines from tangling with the upper end portion of corner column 21-24, plates 54 and/or upper horizontal beam 33, 34, or 37, 38.

Figure 2:
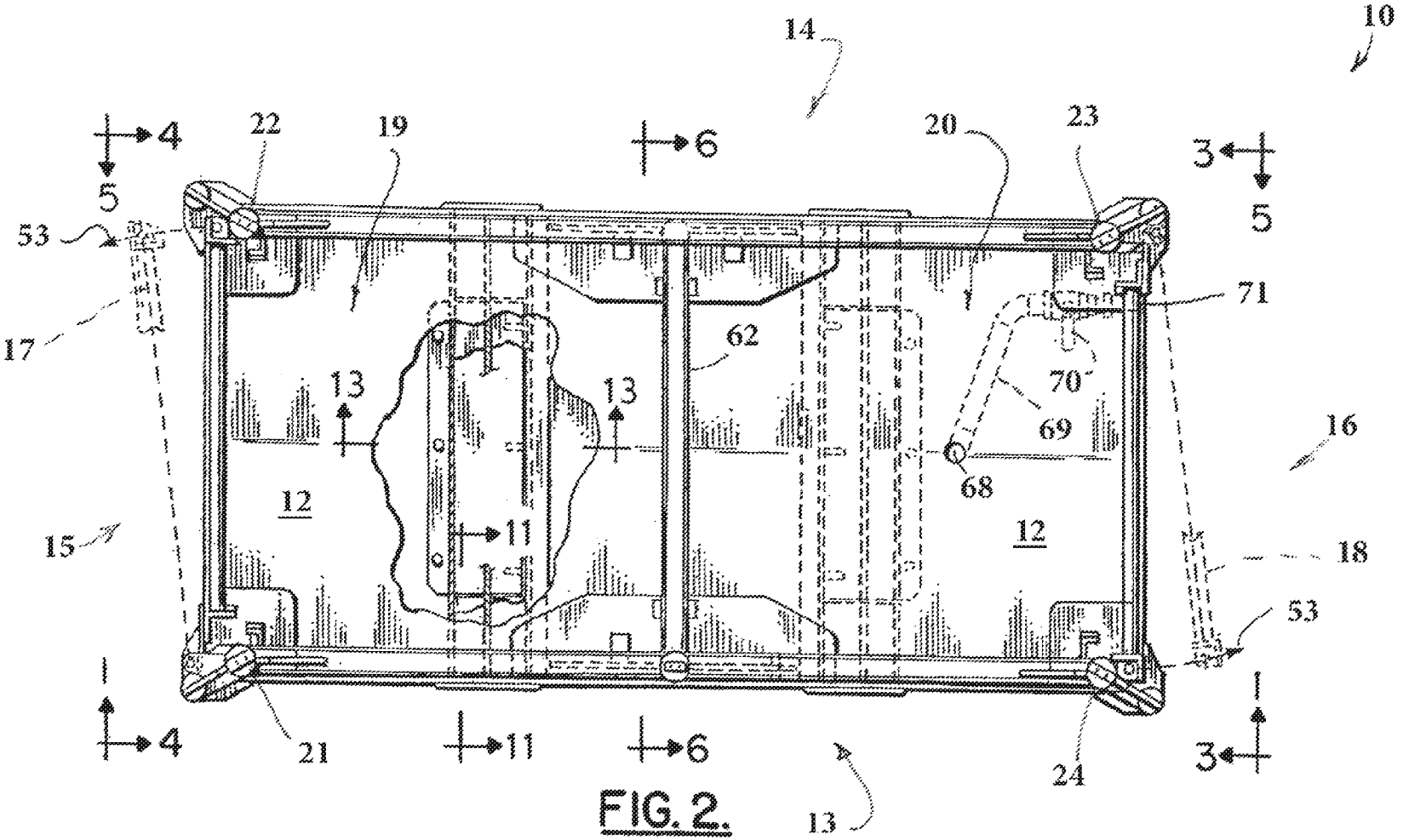
FIG. 2 is a plan view of a preferred embodiment of the apparatus of the present invention taken along lines 2-2 of FIG. 1.
Figure 4:
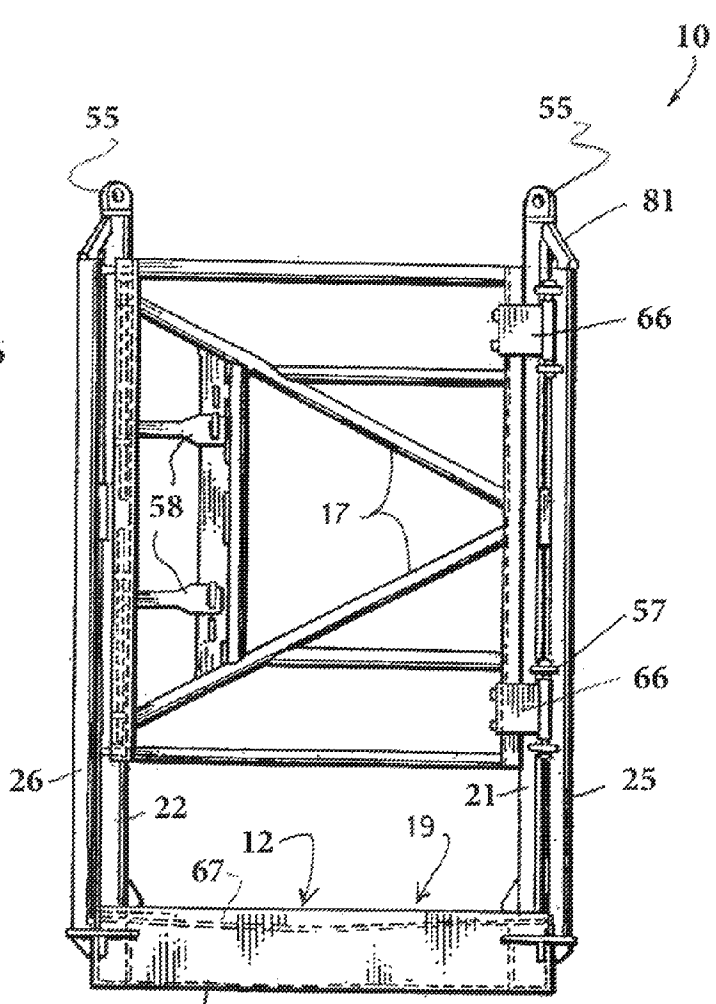
FIG. 4 is an end view of a preferred embodiment of the apparatus of the present invention taken along lines 4-4 of FIG. 2.
Figure 3:
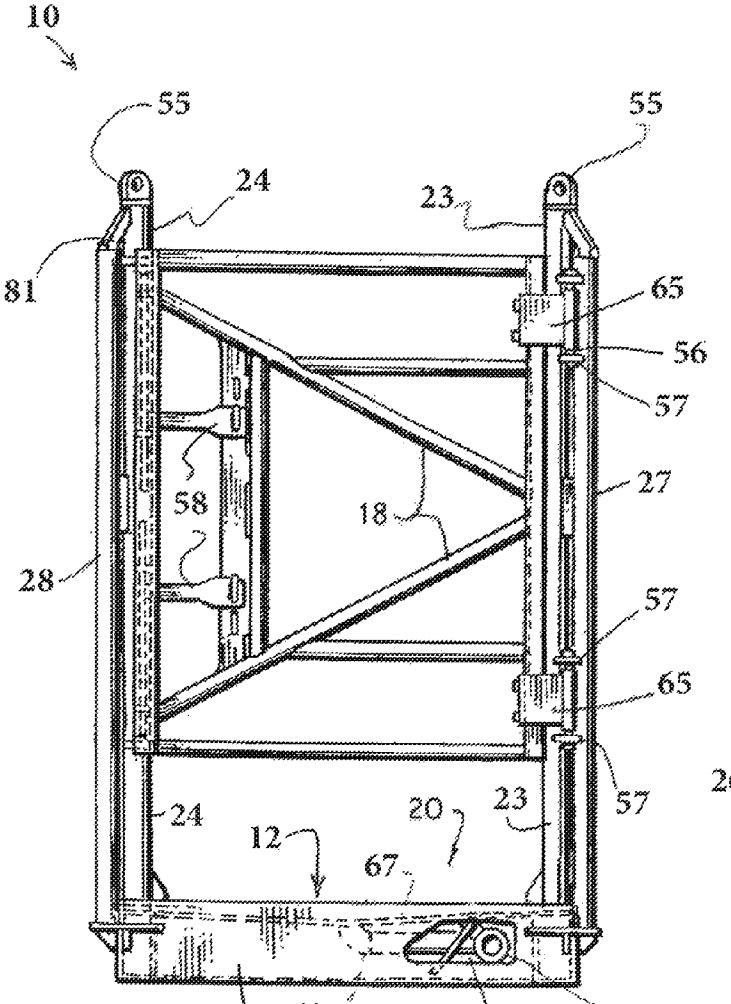
FIG. 3 is an end view of a preferred embodiment of the apparatus of the present invention taken along lines 3-3 of FIG. 2.
Figure 6:
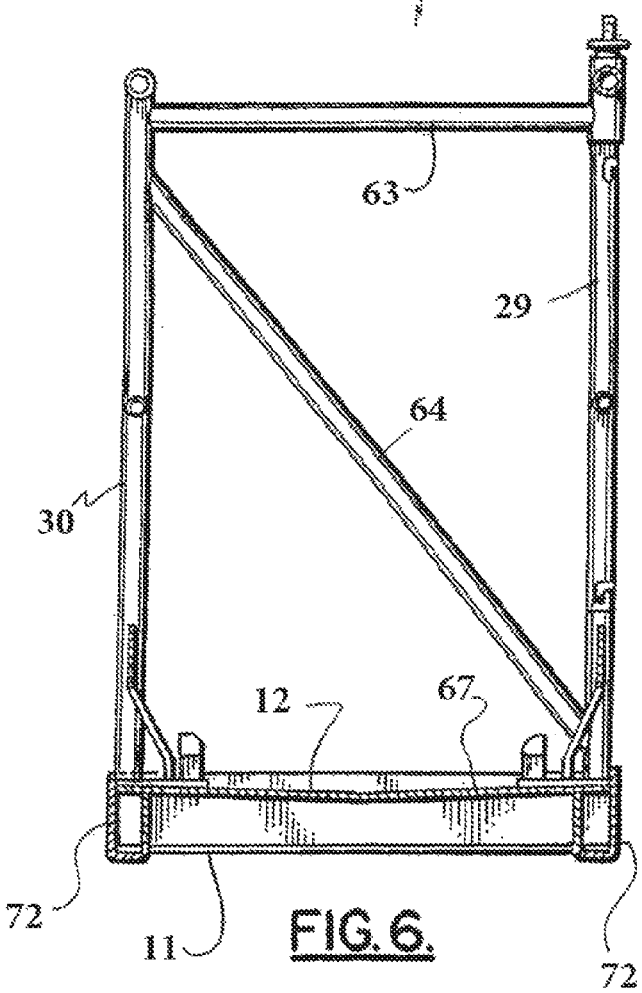
FIG. 6 is a sectional view of a preferred embodiment of the apparatus of the present invention taken along lines 6-6 of FIG. 2.
Figure 7:
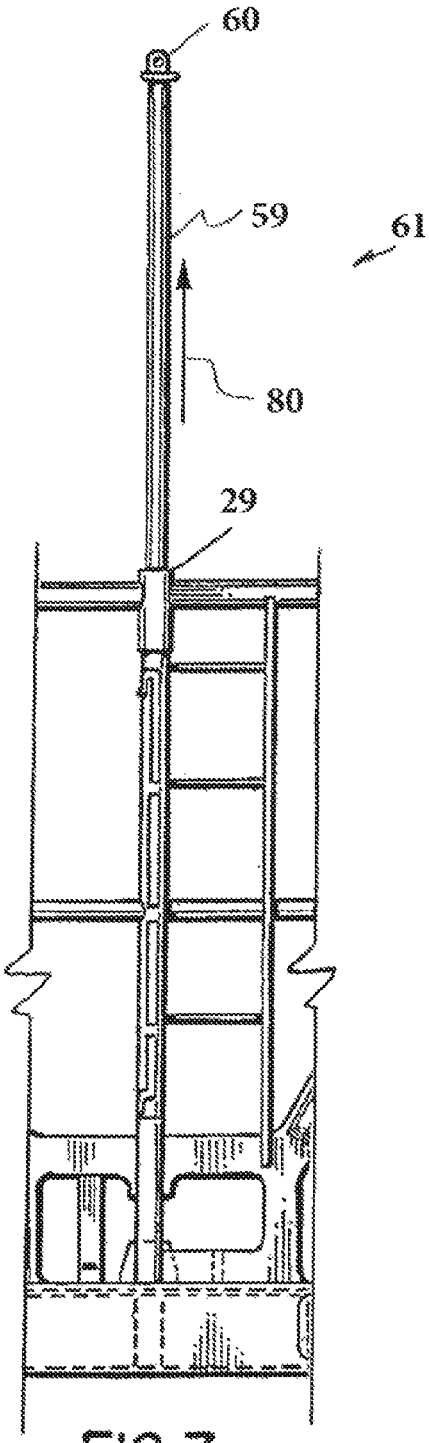
FIG. 7 is a fragmentary view of a preferred embodiment of the apparatus of the present invention showing elevating safety support.
Figure 8:
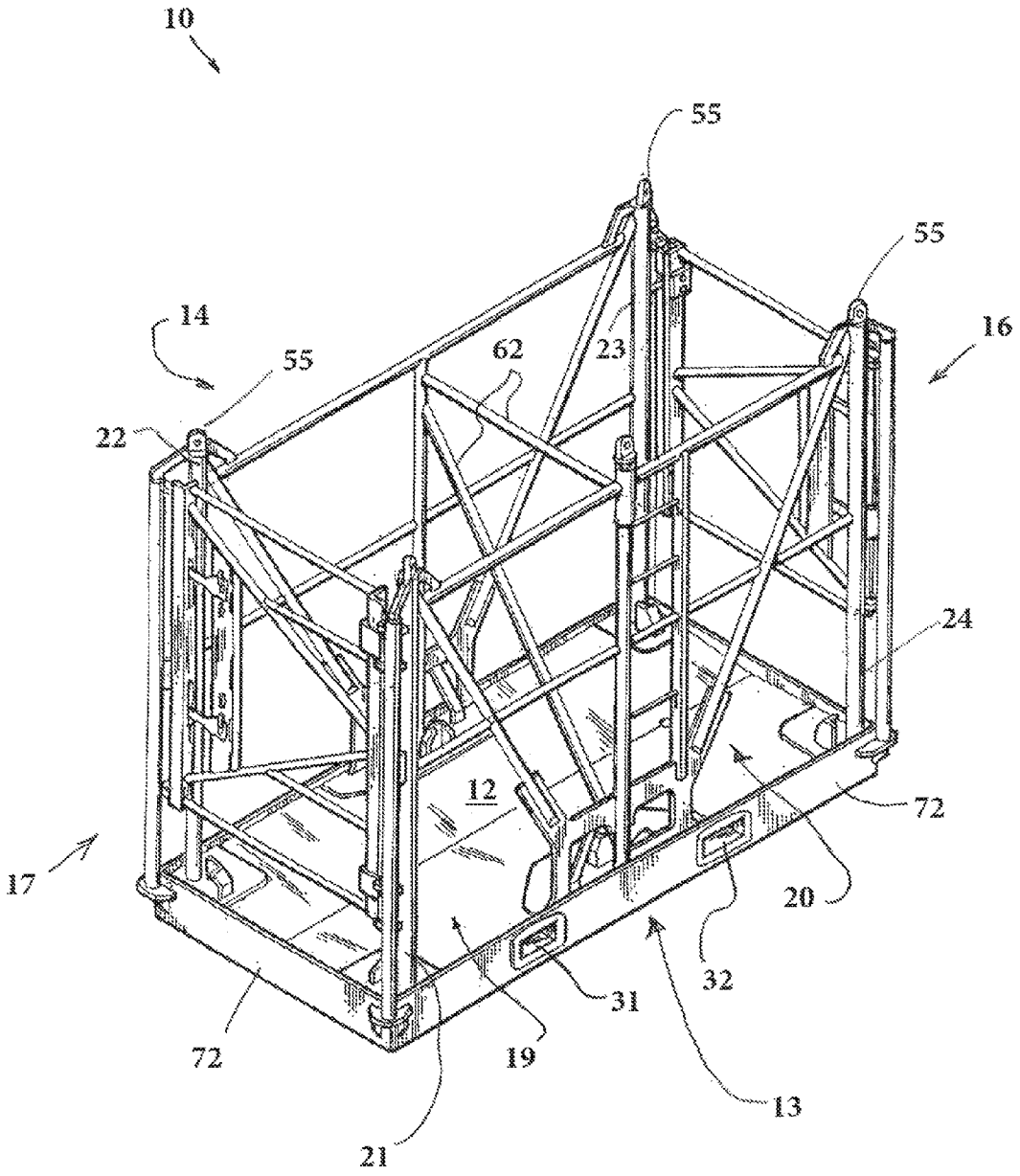
FIG. 8 is a perspective view of a preferred embodiment of the apparatus of the present invention.

In FIGS. 2 and 6, middle wall 62 provides upper horizontal support 63 that spans between intermediate columns 29, 30. Diagonal support 64 extends from an upper end portion of intermediate column 30 to a lower end portion of column 29 as seen in FIG. 6.

Floor 12 can have a grade or slant 67 to channel any spills to drain 68 (see FIGS. 1-3 and 6). Drain 68 connects to flow line 69 which has valve 70. Opening 71 in base 11 allows access to valve 70.

The following is a list of suitable parts and materials for the various elements of a preferred embodiment of the present invention.

PARTS LIST

| PART NO. | DESCRIPTION |
|---|---|
| 10 | transportable rack apparatus |
| 11 | base/substructure |
| 12 | platform/floor |
| 13 | side |
| 14 | side |
| 15 | end |
| 16 | end |
| 17 | door |
| 18 | door |
| 19 | floor segment |
| 20 | floor segment |
| 21 | corner column |
| 22 | corner column |
| 23 | corner column |
| 24 | corner column |
| 25 | vertical support |
| 26 | vertical support |
| 27 | vertical support |
| 28 | vertical support |
| 29 | intermediate column |
| 30 | intermediate column |
| 31 | socket/tube |
| 32 | socket/tube |
| 33 | upper horizontal beam |
| 34 | upper horizontal beam |
| 35 | lower horizontal beam |
| 36 | lower horizontal beam |
| 37 | upper horizontal beam |
| 38 | upper horizontal beam |
| 39 | lower horizontal beam |
| 40 | lower horizontal beam |
| 41 | diagonal beam |
| 42 | diagonal beam |
| 43 | diagonal beam |
| 44 | diagonal beam |
| 45 | plate |
| 46 | plate |
| 47 | plate |
| 48 | plate |
| 49 | vertical section |
| 50 | horizontal section |
| 51 | diagonal section |
| 52 | opening |
| 53 | arrow |
| 54 | plate |
| 55 | lifting eye |
| 56 | hinge pin |
| 57 | hinge plate |
| 58 | gate latch |
| 59 | fall arrest pole |
| 60 | eyelet |
| 61 | elevated position |
| 62 | middle wall |
| 63 | upper horizontal support |
| 64 | diagonal support |
| 65 | hinge |
| 66 | hinge |
| 67 | slant/grade |
| 68 | drain |
| 69 | flow line |
| 70 | valve |
| 71 | opening |
| 72 | rim beam/perimeter beam |
| 73 | torque tube |
| 74 | gusset |
| 75 | fork tube bottom plate |
| 76 | fork tube side plate |
| 77 | bolted connection |
| 78 | angle |
| 79 | plate |
| 80 | arrow |
| 81 | plate |
| 82 | plate |
| 83 | rod |
| 84 | bearing |
| 85 | locking tube |
| 86 | vertical beam |

-continued

| PARTS LIST | |
|---|---|
| PART NO. | DESCRIPTION |
| 87 | arrow |
| 88 | arrow |

All measurements disclosed herein are at standard temperature and pressure, at sea level on Earth, unless indicated otherwise.

The foregoing embodiments are presented by way of example only; the scope of the present invention is to be limited only by the following claims.

The invention claimed is:

1. A cargo rack comprising:

a) a frame having a base, a front, a rear, and upper and lower end portions;

b) the base of the frame having a perimeter and a floor providing multiple load holding positions, each configured to hold a load module;

c) a plurality of load modules that are supported with the frame during use;

d) the frame including a plurality of side walls that attach to and extend upwardly from the perimeter and including at least left and right side walls, first and second frame ends, the frame having four corners with a corner column at each corner;

e) each side wall having at least one intermediate column positioned in between two said corner columns;

f) the upper end portion of each side wall having an upper beam that connects an upper end of each said corner column to each said respective intermediate column;

g) a plurality of gates that are movably mounted to the frame, each gate being movably attached to a said side wall between open and closed positions, each gate spanning across a said end in a horizontal direction from one said corner column to another said corner column; and h) multiple reinforcements that connect each said intermediate column to said corner columns on the side walls, including reinforcing beams that extend between a said corner column and a said intermediate column at a position in between the base and said upper beam;

i) said reinforcements including a diagonally extending member that extends from the top of a respective said corner column downwardly to a position next to the lower end of a respective said intermediate column;

j) a plate that connects the lower end of a respective said diagonal member to both the base and a respective said intermediate column; and k) wherein the gates enable a said load module to be removed laterally with a fork lift when a selected said gate is in the open position and without removing another said load module.

2. The cargo rack of claim 1 wherein there are two load holding positions.

3. The cargo rack of claim 1 further comprising a laterally extending beam on each said side wall that extends from a said corner column to a said diagonally extending member.

4. A cargo rack comprising:

a) a frame having a base, a front, a rear, and upper and lower end portions;

b) the base of the frame having a perimeter and a floor providing multiple load holding positions, each configured to hold a load module;

c) a plurality of load modules that are supported with the frame during use;

d) the frame including a plurality of side walls that attach to and extend upwardly from the perimeter and including at least left and right side walls, first and second frame ends, the frame having four corners with a corner column at each corner;

e) each side wall having at least one intermediate column positioned in between two said corner columns;

f) the upper end portion of each side wall having an upper beam that connects an upper end of each said corner column to each said respective intermediate column;

g) a plurality of gates that are movably mounted to the frame, each gate being movably attached to a said side wall between open and closed positions, each gate spanning across a said end in a horizontal direction from one said corner column to another said corner column; and h) multiple reinforcements that connect each said intermediate column to said corner columns on the side walls, including reinforcing beams that extend between a said corner column and a said intermediate column at a position in between the base and said upper beam;

i) said reinforcements including a diagonally extending member that extends from the top of a respective said corner column downwardly to a position next to the lower end of a respective said intermediate column;

j) a plate that connects the lower end of a respective said diagonal member to both the base and a respective said intermediate column; and k) wherein the gates enable a said load module to be removed laterally with a fork lift when a selected said gate is in the open position and without removing another said load module; and l) wherein there is a drain opening in the floor on one of the load holding positions.

5. The cargo rack of claim 1 further comprising a pair of tanks, one on each load holding position.

6. The cargo rack of claim 1 further comprising a dividing beam that separates one of said load holding positions from another of said load holding positions.

7. A cargo rack comprising:

a) a frame having a base with a base perimeter that includes a plurality of beams, a front, a rear, upper and lower end portions, the frame holding at least a pair of load modules;

b) the frame including a plurality of side walls and end walls extending upwardly from the base at the base perimeter and including at least left and right side walls, four corners that each provide a corner column and an intermediate column at each side wall spaced in between two of said corner columns;

c) the upper portion of each side wall having an upper beam that connects an upper end of each said corner column to an upper end of each said respective intermediate column;

d) at least one of the end walls being one or more gates movably mounted to the frame, each gate being movable between open and closed positions;

e) multiple reinforcements that connect each said intermediate column to a pair of said corner columns, including reinforcing beams that extend both horizontally and diagonally between a said corner column and a said intermediate column at a position in between the base and a respective one of said upper beams;

f) a plate that connects the lower end of a said reinforcing beam to both the said base and a respective said intermediate column; and g) wherein the one or more the gates enable any one of the load modules to be removed laterally with a fork lift when a selected said gate is in the open position and without removing any other one of the modules.

8. The cargo rack of claim 7 wherein there is a said gate at each end of the frame.

9. The cargo rack of claim 7 wherein there are multiple said diagonally extending beams that intersect multiple said horizontally extending beams.

10. A cargo rack comprising:

a) a frame having a base with a base perimeter that includes a plurality of beams, a front, a rear, upper and lower end portions, the frame holding at least a pair of load modules;

b) the frame including a plurality of side walls and end walls extending upwardly from the base at the base perimeter and including at least left and right side walls, four corners that each provide a corner column and an intermediate column at each side wall spaced in between two of said corner columns;

c) the upper portion of each side wall having an upper beam that connects an upper end of each said corner column to an upper end of each said respective intermediate column;

d) at least one of the end walls being one or more gates movably mounted to the frame, each gate being movable between open and closed positions;

e) multiple reinforcements that connect each said intermediate column to a pair of said corner columns, including reinforcing beams that extend both horizontally and diagonally between a said corner column and a said intermediate column at a position in between the base and a respective one of said upper beams;

f) a plate that connects the lower end of a said reinforcing beam to both the said base and a respective said intermediate column;

g) wherein the one or more the gates enable any one of the load modules to be removed laterally with a fork lift when a selected said gate is in the open position and without removing any other one of the modules; and h) wherein the floor includes inclined portions.

11. The cargo rack of claim 10 wherein there is a drain in the floor.

12. The cargo rack of claim 7 wherein the floor attaches to the perimeter beams.

13. The cargo rack of claim 7 further comprising a vertical support next to each corner column that is mounted to the base and that connects at intervals to the said corner column.

14. The cargo rack of claim 13 wherein there are multiple hinge mounts that attach to both a said corner column and a respective said vertical support.

15. A method of transporting load modules, comprising the steps of:

a) providing a frame having a base with a floor, a front, a rear, and upper and lower end portions, and a pair of open ended parallel fork lift tine sockets, the frame including a plurality of side walls extending upwardly from the base and including at least left and right side walls, said side walls having corner columns and intermediate columns, each said intermediate column positioned in between two said corner columns;

b) the upper end portion of each said side wall having an upper beam that connects an upper end of each respective said corner column to each respective said intermediate column;

c) mounting a plurality of gates to the frame, each gate being movable between open and closed positions, the open position of each gate providing an open doorway, the gates enabling a fork lift to place a selected one of the said load modules on the floor by moving the selected load module laterally through a said open doorway;

d) providing multiple reinforcements that connect each said intermediate column to said corner columns on the side walls, including reinforcing beams that extend between a said corner column and a said intermediate column at a position in between the base and a respective said upper beam and multiple diagonal beams;

e) the floor having a plurality of load holding positions, each having one or more restraints that both vertically and laterally hold a said load module in position once a load is placed on the floor;

f) wherein step "c" includes the gates exposing a majority of the width of the floor for loading when opened;

g) the gates enabling removal of any one of said load modules laterally with a fork lift when a said gate is opened and without removing any other one of the modules; and h) connecting each diagonal beam to both the floor and a respective said intermediate beam with a plate.

16. The method of claim 15 wherein there two load holding positions.

17. The method of claim 15 wherein there are a pair of gates.

18. The method of claim 15 wherein there are horizontal and vertical components of said plate.

19. The method of claim 15 wherein the floor is at least partially inclined.

20. The method of claim 15 wherein there is a plate opening in the plate.

21. The method of claim 19 wherein the plate attaches to the floor at a position spaced away from one of said intermediate beams.

22. The method of claim 15 further comprising lift eyes on the corner columns.

* * * * *